United States Patent [19]

Chance et al.

[11] Patent Number: 4,955,807

[45] Date of Patent: Sep. 11, 1990

[54] SPIRAL COIL CANDLE HOLDER FOR PUMPKINS AND OTHER SUBSTRATES

[75] Inventors: Allen Chance, Mill Valley; William Gray, Topanga, both of Calif.

[73] Assignee: Concept Manufacturing, Topanga, Calif.

[21] Appl. No.: 278,812

[22] Filed: Dec. 2, 1988

[51] Int. Cl.[5] ..... F23D 3/16

[52] U.S. Cl. ..... 431/296; 431/289; 362/122; 362/806; 248/523

[58] Field of Search ..... 431/292, 294, 295, 296, 431/297, 289, 343; 248/156, 160, 523, 530; 40/538, 540; 446/485; 362/122, 161, 382, 392, 257, 806

[56] References Cited

U.S. PATENT DOCUMENTS

| | | | |
|---|---|---|---|
| 33,788 | 11/1861 | Marsden et al. . | |
| 151,055 | 5/1874 | Reessing . | |
| 295,182 | 3/1884 | Lechler . | |
| 501,473 | 7/1893 | Stille et al. | 431/294 |
| 539,199 | 5/1895 | Stille et al. . | |
| 903,067 | 11/1908 | Engman . | |
| 1,424,573 | 8/1922 | Larson . | |
| 1,610,259 | 12/1926 | Clark | 248/156 |
| 1,726,817 | 9/1929 | Franklin | 248/160 X |
| 1,911,983 | 5/1933 | Addis et al. . | |
| 2,151,192 | 3/1939 | Crosser | 431/295 |
| 2,520,818 | 8/1950 | Terry . | |
| 2,577,333 | 12/1951 | Klum et al. . | |
| 2,786,345 | 3/1957 | Scherer . | |
| 3,067,717 | 12/1962 | Imparato | 248/156 X |
| 3,240,035 | 3/1966 | Anderson | 431/290 |
| 3,317,168 | 5/1967 | Ziph . | |
| 3,586,274 | 6/1971 | Hart . | |
| 3,743,473 | 7/1973 | Von Suskil . | |
| 3,932,113 | 1/1976 | Thrush . | |
| 3,996,707 | 12/1976 | Frye . | |
| 4,072,286 | 2/1978 | Foncannon . | |
| 4,328,942 | 5/1982 | Birnbaum . | |
| 4,454,824 | 6/1984 | Wood . | |

FOREIGN PATENT DOCUMENTS

| | | | |
|---|---|---|---|
| 517861 | 1/1931 | Fed. Rep. of Germany | 431/296 |
| 290328 | 8/1953 | Switzerland | 431/297 |
| 17267 | 7/1897 | United Kingdom | 431/294 |
| 28789 | 12/1909 | United Kingdom | 248/156 X |
| 20418 | of 1910 | United Kingdom | 431/297 |

*Primary Examiner*—Carl D. Price

*Attorney, Agent, or Firm*—Pretty, Schroeder, Brueggemann & Clark

[57] ABSTRACT

A spiral coil candle holder for anchoring a candle to the bottom of a jack-o-lantern or other stable substrate. The candle holder includes a filament shaped into a plurality of convolutions forming a spiral coil having an aperture of varying diameter capable of securely holding various size candles. The candle holder has a spiral coil bottom so that it can be embedded into the pumpkin in a cork-screw-like manner.

9 Claims, 1 Drawing Sheet

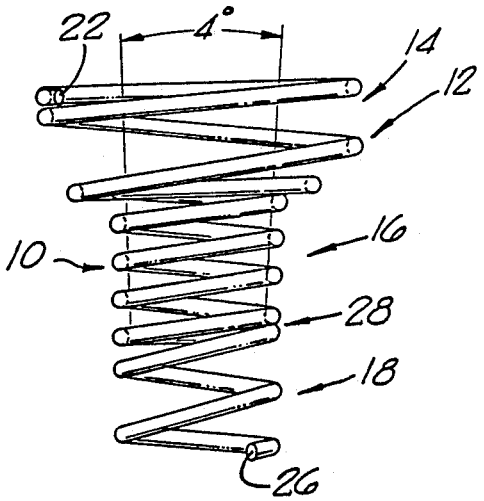
FIG. 1.
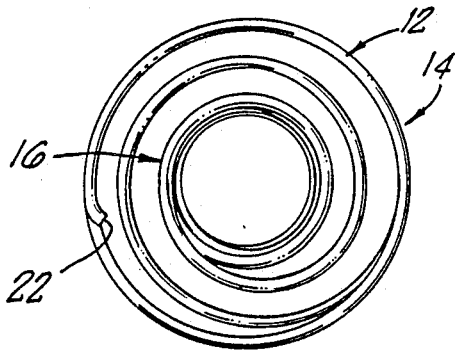
FIG. 2.
FIG. 3.
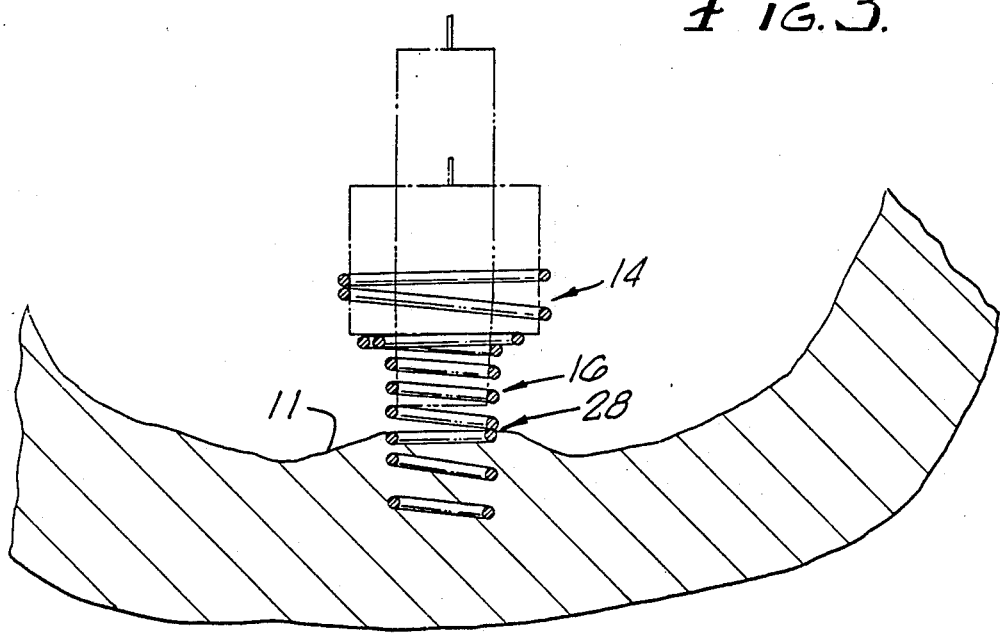

SPIRAL COIL CANDLE HOLDER FOR PUMPKINS AND OTHER SUBSTRATES

BACKGROUND OF THE INVENTION

This invention relates generally to a device for anchoring, or securing, a candle to a substrate, and more particularly, to a spiral coil candle holder which is embedded into a hollowed-out pumpkin, or jack-o-lantern, in a corkscrew-like manner and having a diameter varying in size such that the candle holder is capable of holding a variety of candles of different heights and diameters.

The inside bottom of a hollowed-out pumpkin has a vertically protruding hump or mound known as the bloom point which makes it difficult to securely fix a candle at that spot. Candles have been fixed to the bottom of jack-o-lanterns by a number of methods; however, these methods generally tend to be unsuccessful or unsatisfactory in one way or another. For instance, one method involves placing a candle in a sufficient quantity of melted wax on the bottom of the pumpkin so that the candle will become secured to the bottom when the wax hardens. Alternatively, the candle can be secured in melted wax dripped onto a dish or plate which is then placed at the bottom of the pumpkin on the bloom point. However, both of these methods are unsatisfactory since the candles tend to become unsecured if the pumpkin is moved or if the wax securing the candles melts or softens from the heat produced by the candle flame. These methods also prove to be especially inadequate for anchoring long, narrow candles which are easily toppled if not tightly secured. In addition, there can be a potential for fire if the candle falls over as a result of these inadequate means for anchoring a candle to the pumpkin. Furthermore, the melted wax residue left on the dish or plate is very difficult to clean.

It should, therefore, be appreciated that there is a need for a candle holder which aids in overcoming the above problems and can securely anchor candles of various heights and diameters to the bottom or bloom point of a pumpkin or other substrate to reduce the risk of falling over and the potential for starting a fire, and is easy to use and to clean. The present invention provides the necessary solution.

SUMMARY OF THE INVENTION

The present invention is embodied in an easy to use and clean candle holder for anchoring candles of various heights and diameters to the bottom of a jack-o-lantern to reduce the possibility that the candles can become unsecured and create a possible risk of fire. The candle holder can also be used to secure candles to other substrates. For instance, the candle holder can be embedded into a potato and used to anchor a candle inside the bottom of a paper bag so that the bag will be illuminated and can be used as a decoration, such as those commonly used at Christmas time.

The candle holder of the present invention includes a spiral coil consisting of a filament formed in the shape of a continuous plurality of convolutions which creates an aperture having a varying diameter which allows it to receive and securely hold various size candles. The spiral coil of the candle holder has generally three sections. The upper section of the spiral coil is the largest in diameter and is sized to receive various sizes of votive candles which are often used in jack-o-lanterns. The middle section of the candle holder has a diameter smaller than the upper section but is also sized to receive various size candles. The middle section can be tapered from wide to narrow at a slight angle in the top to bottom direction in order to accommodate more than one size candle. The degree of taper need only be very slight, such as about two degrees. The bottom section of the spiral coil generally has a diameter substantially the same as the middle section. The bottom section is used to anchor the candle holder to the pumpkin by sticking the free end of the bottom section into the pumpkin and then turning the candle holder in a corkscrew-like fashion until it is securely embedded in the pumpkin.

In a more detailed feature of the invention, a closed coil stop can be incorporated into the candle holder to prevent the candle holder from being further embedded into the pumpkin once it has reached a predetermined distance. This prevents the problem of turning the candle holder too much while embedding it into the pumpkin, thereby puncturing the outside of the pumpkin and causing the pumpkin to crack or split.

In another feature of the invention, the top free end of the spiral coil of the upper section is turned inward toward the aperture so that it protrudes into or abuts against a candle placed in the candle holder and further aids in preventing the candle from becoming unsecured. In yet another feature of the invention, the spiral coil of the candle holder is made of a metal, such as a wire, or similar material, having high heat transfer characteristics which is not destroyed or deformed by the heat generated from the flames of the candle. This allows the candle holder to heat up sufficiently to melt the wax away from the spiral coils without the wax gathering up or collecting on the coils and making it difficult to clean. Thus, the candle holder of the present invention functions in a "self-cleaning" manner.

BRIEF DESCRIPTION OF THE DRAWINGS

FIG. 1 is a side-view of a spiral coil candle holder embodying the invention.

FIG. 2 is a top perspective view of the spiral coil candle holder of FIG. 1, showing the varying diameter of the candle holder.

FIG. 3 is a cross-sectional view of the spiral coil candle holder of FIG. 1, embedded into a pumpkin, and showing its capability of holding various size candles.

DESCRIPTION OF THE PREFERRED EMBODIMENT

With reference now to the illustrative drawings, there is shown an embodiment of a spiral coil candle holder 10 for use in anchoring candles to the bottom of a pumpkin 11 or other substrate. The candle holder includes a filament shaped in a plurality of convolutions to form a spiral coil 12, having generally an upper section 14, a middle section 16, and a bottom section 18. However, it should be noted that the invention can embody a multitude of sections each capable of receiving and holding various sizes of candles. The upper section 14 of the spiral coil has a top free end 22, while the bottom section 18 terminates in a bottom free end 26. The diameter of the upper section 14 is preferably substantially larger than the middle section 16.

In the candle holder 10 of the present invention, the use of a spiral coil 12 allows the candle holder to be securely embedded into the bloom point of the pumpkin 11. Also, once the candle holder is embedded into the pumpkin, water can be poured into the pumpkin to a certain level around the candle holder so that the water may douse the flame of the candle in the event the jack-o-lantern is turned over and thereby further prevent a fire hazard. Furthermore, the varying diameter of the spiral coils allows candles of various diameters to be securely held in the candle holder which also reduces the possibility of the candle falling over.

More specifically, the candle holder 10 is anchored to the bottom of the pumpkin 11 by sticking the bottom free end 26 into the pumpkin and turning the candle holder in a corkscrew-like fashion so that the candle holder embeds itself into the pumpkin until it is securely anchored. Once this is done, the candle is placed in the candle holder. The device also enables the user to turn the pumpkin on its side to light the candle thus avoiding the possibility of the flame rising in the direction of the user and causing burns. The diameter of the upper section 14 is large enough to receive various size candles, such as votive candles which are commonly used in jack-o-lanterns. The middle section 16 is capable of holding candles of a smaller diameter than the ones which could be placed in the upper section. The middle section preferably is tapered at a slight angle so that the diameter decreases from top to bottom. This enables the middle section to accommodate more than one size of candle. The invention also contemplates that the upper section may also be tapered to achieve the same result.

The middle section 14 of the candle holder also has the advantage of being sized to hold a miniature flashlight. Many minature flashlights have a candle mode which enable them to replace the candles typically used in jack-o-lanterns. Thus, by alternatively allowing flashlights to be used instead of candles, the candle holder of the present invention can totally eliminate the risk of fire. Accordingly, the term "candle" as used herein is intended to include a flashlight.

The candle holder preferably also includes a bottom section 18 having a closed coil stop 28 wherein the coils of the candle holder at this point are spaced sufficiently close together to limit the distance in which the candle holder can be embedded into the pumpkin 11. This ensures that the candle holder will only penetrate the pumpkin to a uniform predetermined distance, i.e., up to the closed coil stop. This minimizes the possibility that the candle holder will fracture or crack the pumpkin by puncturing the outside bottom of the pumpkin as a result of excessive turning of the candle holder.

The spiral coil candle holder preferably further includes a top free end 22 which can be turned slightly inward toward the aperture created by the spiral coil such that the top free end abuts against or protrudes into a candle placed into the candle holder. Thus, the top free end turned in this manner further insures that the candle remains securely in place.

The spiral coil 12 of the candle holder 10 is made of a material having high heat transfer characteristics which is not destroyed or deformed by the heat from the candle. The spiral coil is preferably a wire made from a metal, such as aluminum, steel or iron. The material selected should be able to heat up sufficiently to allow the wax from the candle to melt away from the spiral coil, thereby making the candle holder "self-cleaning."

The invention also contemplates that the candle holder can be used to anchor candles to other substrates. For example, lighted candles are sometimes placed in sand at the bottom of white paper bags to illuminate designs on the bags. These illuminated bags are often used as outdoor Christmas decorations. However, the candles in these decorations also tend to become unsecured in the sand or dirt which often is used to support the candle. The candle holder of the present invention can be embedded into a potato or other stable substrate and then placed at the bottom of the paper bag. Securing the candle in this matter aids in reducing the possibility of the candle toppling over and risking the start of a fire. Thus, it is apparent that the candle holder can be used with other substrates for other uses where it is important to securely anchor a lighted candle.

Although the present invention has been described in detail with reference only to the presently preferred embodiment, it will be appreciated by those of ordinary skill in the art that various modifications can be made without departing from the invention. Accordingly, the invention is limited only by the following claims.

I claim:

1. A pumpkin candle holder made from a spiral coil comprising:

an upper spiral coil section having a diameter sized to receive votive candles having various diameters;

a middle spiral coil section connected to said upper spiral coil section and having a diameter smaller than the diameter of said upper spiral coil section, said middle spiral coil section sized to receive candles of varying diameters;

a bottom spiral coil section connected to said middle spiral coil section for embedding said pumpkin candle holder into a pumpkin;

said spiral coil also including a closed coil stop for limiting the distance that said candle holder can be embedded into the pumpkin; and a free end on the upper spiral coil section which turns inward towards the aperture created by said upper spiral coil section such that said free end protrudes into a candle placed in said candle holder, thereby further securing said candle in said candle holder.

2. The pumpkin candle holder as set forth in claim 1 wherein at least one of said sections is tapered in width, from wide to narrow, from the top to bottom direction.

3. The pumpkin candle holder as set forth in claim 2 wherein the middle spiral coil section is tapered in width, from wide to narrow, at a two degree angle.

4. The pumpkin candle holder as set forth in claim 1 wherein said pumpkin candle holder is constructed of material which will not be deformed from the heat generated from the flames of a candle placed in said pumpkin candle holder.

5. The pumpkin holder as set forth in claim 4 wherein said material is self-cleaning due to said heat.

6. The pumpkin holder as set forth in claim 1 wherein said pumpkin candle holder is constructed of metal.

7. A candle holder as set forth in claim 1 wherein said spiral coil consists of a filament formed in the shape of a continuous plurality of convolutions.

8. A candle holder as set forth in claim 1 wherein said stop is located between the middle and bottom spiral coil sections.

9. A candle holder made from a spiral coil and having a multitude of sections comprising:

an upper spiral coil section having a diameter sized to receive votive candles having various diameters;

a middle spiral coil section connected to said upper spiral coil section and having a diameter smaller than the diameter of said upper spiral coil section, said middle spiral coil section sized to receive candles of varying diameters;

a bottom spiral coil section connected to said middle spiral coil section for embedding said candle holder into a substrate;

said spiral coil also including a closed coil stop located at the upper end of said bottom spiral coil section for limiting the distance that said candle holder can be embedded into the substrate;

a free end on the upper spiral coil section which turns inward towards the aperture created by said upper spiral coil section such that said free end protrudes into a candle placed in said candle holder, thereby further securing said candle in said candle holder; and wherein at least one of said sections is tapered in width, from wide to narrow, from the top to bottom direction.

* * * * *